US005563609A

United States Patent [19]

Wachs

[11] Patent Number: 5,563,609

[45] Date of Patent: Oct. 8, 1996

[54] ANTENNA SYSTEM WITH PLURAL BEAM SEQUENTIAL OFFSET

[75] Inventor: Marvin R. Wachs, Calabasas, Calif.

[73] Assignee: Hughes Electronics, Los Angeles, Calif.

[21] Appl. No.: 243,351

[22] Filed: May 16, 1994

[51] Int. Cl.[6] ..... H01Q 3/22; H01Q 3/24; H01Q 3/26

[52] U.S. Cl. ..... 342/372; 342/425; 342/352; 342/353

[58] Field of Search ..... 342/352, 353, 342/354, 372, 425, 78, 79; 343/763, 765, 766

[56] References Cited

U.S. PATENT DOCUMENTS

| | | | |
|---|---|---|---|
| 4,236,161 | 11/1980 | Ohm | 343/781 |
| 4,954,832 | 9/1990 | Grant et al. | 342/352 |
| 5,175,556 | 12/1992 | Berkowitz | 342/354 |
| 5,225,841 | 7/1993 | Krikorian et al. | 342/204 |

*Primary Examiner*—Theodore M. Blum
*Attorney, Agent, or Firm*—Elizabeth E. Leitereg; Terje Gudmestad; W. K. Denson-Low

[57] ABSTRACT

An array antenna system (40) has a plurality of radiators (44) for generating a set of beams (48), wherein axes of the beams are spaced apart from each other allowing the respective beams to illuminate separate areas of the earth or other receiving region. A sequence of positional offsets (52) is applied to the set of beams by either mechanically (108) moving the radiators to redirect the beams, or by introducing a phase or time-delay taper (84) to the phase shifters (80) or delay lines of a beam former (38) for each of the beams. The succession of positional offsets redirects the beams along a path offset from a central location (50) of each beam, and passing between the sites of adjacent beams. This provides for improved uniformity of illumination of the receiving region. In the event that the antenna system includes time division multiplexing (66) of signals applied (68A–C) to the various beams, the multiplexing is synchronized (98) with the progression of directional offsets to the respective beams to enable a burst transmission to be aimed directly at a receiving site (32) on the earth. Typically, the beams are spaced apart by approximately one beam width.

8 Claims, 6 Drawing Sheets

WEIGHTING
PHASE SHIFT AND AMPLITUDE WEIGHT
WEIGHT
POWER DIVIDE (BEAM 1)
POWER DIVIDE (BEAM 2)
POWER DIVIDE (BEAM 3)
RCVR
MEMORY BEAM FORMING
MEM. SYS.
ROM 1 DITHER
ROM 2 DITHER
ROM 9 DITHER
TIMING
CLOCK
ADDR COUNT
DITHER BEAM COUNT
SATELLITE
EARTH
TCVR (HUB)
TCVR
TOMA TIMING CIRCUITRY

ANTENNA SYSTEM WITH PLURAL BEAM SEQUENTIAL OFFSET

BACKGROUND OF THE INVENTION

This invention relates to multiple beam antennas such as those used in satellite communication systems for illuminating a substantial portion of the earth's surface and, more particularly, to a wide-area coverage by spaced-apart high-gain beams including a sequential offsetting of a set of plural high-gain beams along a set of paths which carries each beam around a central location thereof, so as to illuminate areas between locations of high beam intensity for improved uniformity of illumination.

A multiple beam antenna array is employed to provide high gain coverage of a wide area; the beams are spaced apart so as to increase the areas of illumination attainable with the limited number of beams. However, the resulting illumination of a reception region, such as a region of the earth having receivers for receiving satellite communications, varies in intensity of received electromagnetic power. Maximum intensity of illumination is received at areas located on center lines of the beams. Generally, lower gain areas occur at a crossover region between beams. The foregoing example of a communication system has been given in terms of a transmission of electromagnetic power from the antenna, with the illumination intensity varying as a function of the antenna radiation pattern. However, its is to be understood that the operation of a multiple-beam antenna is reciprocal so that the foregoing variation in illumination applies also to reception, at a satellite, of transmissions from ground stations wherein the strength of a signal received at the satellite is dependent upon the location of the transmitting site within the antenna radiation pattern.

The requirements of a point to multi-point communications link may require that maximum antenna gain be provided simultaneously in numerous selected directions. This is particularly true in a situation wherein each of the multi-point communications terminals have minimal rf (radio frequency) link capabilities. An example of this situation is a satellite communication system where many small terminals are dispersed across a global coverage area. A single satellite antenna beam of sufficient gain to communicate over the link covers only a small portion of the necessary coverage area. In this situation, multiple beams can be implemented to cover the required coverage area with a matrix of high gain spot beams.

By way of example, each of the constituent beams may be circular with a peak gain at boresight, and with the gain decreasing with angle off boresight. For continuous coverage of a given region, the beams will be located usually so that the coverage pattern of each beam intersects the coverage pattern of its adjacent neighboring beams at a reduced gain, crossover contour, typically several decibels (dB) below beam peak. As an example, a geosynchronous satellite system can provide full hemispherical coverage of the globe with 109 spot beams, each having a 1.9 degree beam diameter as defined by the −4 dB (relative to peak power) gain contour. For this case, any point in the coverage area would be serviced by a beam at a gain level no lower than 4 dB relative to the peak power of a beam. If the locations of the multi-point terminals are distributed across the coverage region, then some receiving stations will benefit from the relatively high illumination intensity of single point antenna gains approaching peak beam gain while other receiving stations will be serviced by the foregoing minimum crossover gain.

A problem arises in that there are situations wherein these differences in gain, or intensity of illumination, cannot be adequately compensated by receiver circuit construction, and system performance will be degraded for receivers located in the minimum antenna gain regions.

SUMMARY OF THE INVENTION

The aforementioned problem is overcome and other advantages are provided by a multiple-beam antenna system which incorporates the invention to raise the gain of the regions of low gain, or low illumination intensity, to enable all points within the coverage area to be serviced by antenna gain levels approaching the peak gain of the individual spot beams.

In accordance with the invention, the antenna system is provided with means for providing a succession of beam positional offsets in which a beam circulates about a central location of the beam. For example, each beam may transmit in its central location, and then be sequenced step-wise through a set of adjacent beam directions disposed in a circular or square path around the central location. Thereupon, the beam returns to the central direction, momentarily, and resumes the set of sequential offsets in beam direction. The step-wise movement of each beam is timed to provide for equal dwell time at each beam location for uniform illumination of a cell of the reception region, or earth surface in the case of a satellite illuminating the earth. It is to be understood that while the inventive principle of the sequential offsetting of the beam is well suited for satellite communications, this principle of the invention applies also to illumination of other reception regions by systems employing multiple-beam antennas. Furthermore, it is to be understood that while the principles of the invention are explained in the case of the transmission of electromagnetic power from a multiple beam antenna, the principles of the invention apply equally well to the reception of electromagnetic power by a multiple beam antenna.

A feature of the invention employed in the preferred embodiment of the invention provides for a cyclical movement, rather than a random movement, of the beams through their respective paths of motion through the sequential offsets in beam direction. By providing for a pointing offset of the array, in a timed sequence wherein all areas of the reception region are cyclically exposed to gains approaching the peak of the beam, the antenna system is well suited for implementing a communication by use of time burst signaling formats such as time division multiple access (TDMA). To simplify implementation of the invention, it is advantageous to offset all beams concurrently in parallel paths.

By way of example, such offsetting can be accomplished mechanically by physically moving the antenna to provide for different beam pointing angles. Such a mechanical implementation would be limited to a relatively slow rate of offsetting due to stresses and strains placed upon the antenna structure. In the preferred embodiment of the invention, the offsetting of the beam directions is accomplished electronically by use of an electronically steered phased-array antenna. As is well known, beam forming with such an antenna is accomplished by introduction of differential phase shifts or differential delays to signals propagating by the various radiators of the antenna employed in the construction of a beam. Typically, digital or analog commands are applied to the phase shifters to direct insertion of specific amounts of phase or delay to signals propagating via the various radiators. In particular, a differential phase taper extending across an array of radiators introduces a tilting of the beam away from boresight.

The preferred embodiment of the invention utilizes this aspect of beam steering by introduction of additional phase-shift commands which are summed together with the aforementioned phase shift commands and applied to the respective phase shifters to direct a tilting of the respective beams in a prescribed direction off boresight. Thereby, by storing a set of phase shift commands, and by applying all of these phase shift commands to the radiators employed in the construction of each of the beams, all of the beams can be offset in a prescribed direction. By sequentially activating the phase shift commands, the beams can be sequentially stepped in their respective paths of beam offset so as to illuminate, in step-wise fashion, the respective cells of the reception area, or earth's surface, to be illuminated by the multiple-beam antenna.

BRIEF DESCRIPTION OF THE DRAWING

The aforementioned aspects and other features of the invention are explained in the following description, taken in connection with the accompanying drawing wherein.

DETAILED DESCRIPTION

Figure 1:
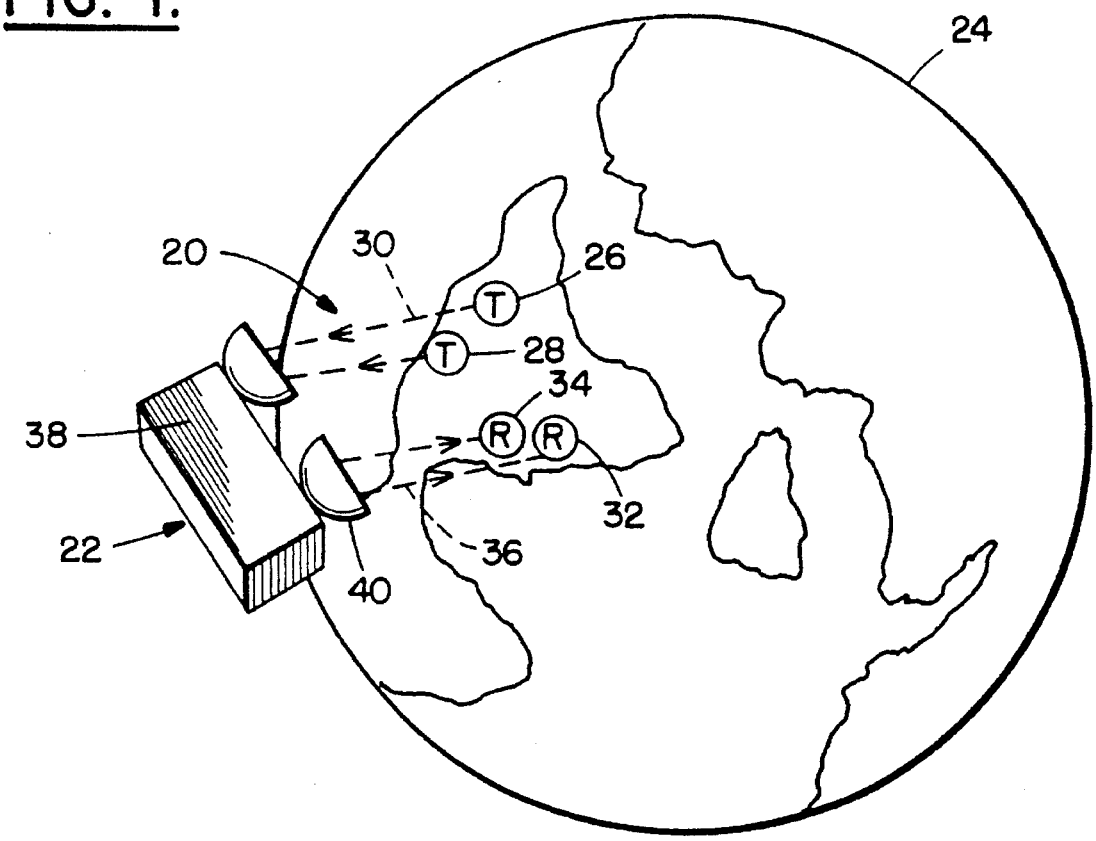
FIG. 1 shows a stylized view of a satellite encircling the earth, the satellite carrying an antenna system embodying the invention.

FIG. 1 shows a satellite communication system 20 with a satellite 22 encircling the earth 24. Two transmitting stations 26 and 28, representative of numerous transmission stations, are located on the earth and transmit electromagnetic signals to the satellite 24 via up-link data channels 30. Two receiving stations 32 and 34, representative of numerous receiving stations, are located on the earth and receive electromagnetic signals from the satellite 22 via down-link data channels 36. Electronic equipment 38 carried by the satellite 22 receives the up-link data for retransmission via the down-link data channels. Included in the satellite 22 is an antenna system 40 indicated schematically as having separate up-link and down-link portions. The antenna system 40 connects with the electronic equipment 38 for receiving the signals of the up-link data channels 30 and for transmitting the signals of the down-link data channels 36.

Figure 2:
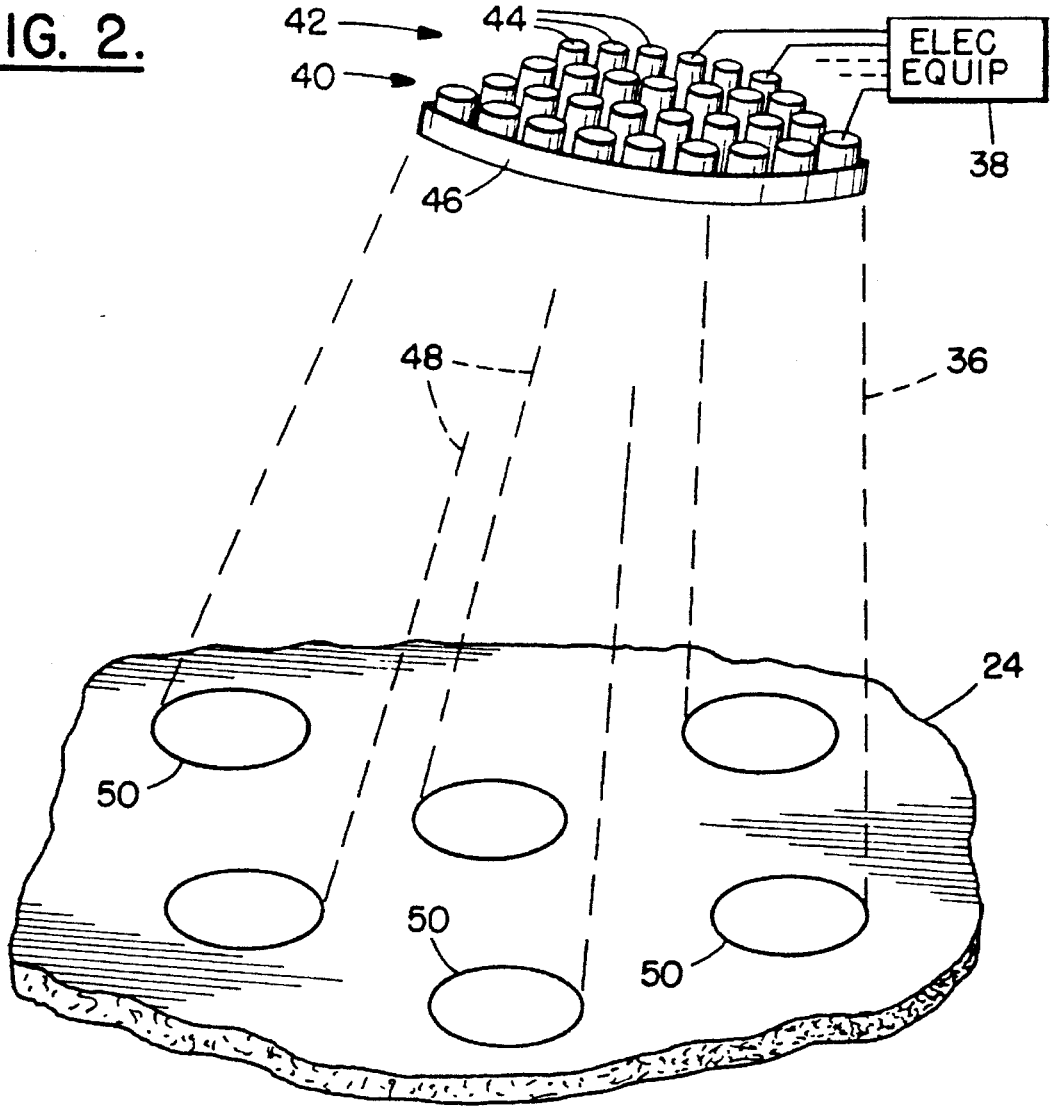
FIG. 2 shows, diagrammatically, a construction of an antenna of FIG. 1 as an array of radiating elements generating multiple beams of electromagnetic power which diverge enroute to the earth's surface for illuminating a region of the earth's surface with varying intensity of illumination.

As shown in FIG. 2, the antenna system 40 comprises an array antenna 42 of radiators 44 arranged side-by-side and supported within a base 46. To facilitate description of the theory of the invention, the radiators 44 are presumed to be transmitting radiators for generating the down-link channels 36. A similar array of radiators (not shown) may be employed for the up-link data channels or, alternatively, in the case of wide-band radiators, the same radiators may be employed for both of the up-link and the down-link channels. In either case, the antenna radiation pattern is characterized by a multiplicity of diverging beams, such as the transmission beams 48 which illuminate a portion of the earth 24, and wherein the most intense regions of illumination by each of the beams 48 is represented by a gain contour 50. By way of example, in order to illustrate the spaced-apart locations of the relatively intense central portion of each of the beams 48, the gain contours 50 may be regarded as approximately the –0.2 dB gain contour. The multiple beams 48 are generated by energizing the radiators 44 with signals having relative phase shifts or delays as provided by the electronic equipment 38 connected to the radiators 44, as will be described hereinafter. To facilitate the description of the invention, the following description is directed to a transmission of radiant energy signals from the satellite for the down-link channels, it being understood that the description applies in analogous fashion to reception of radiant energy signals of the up-link channels.

Figure 3:
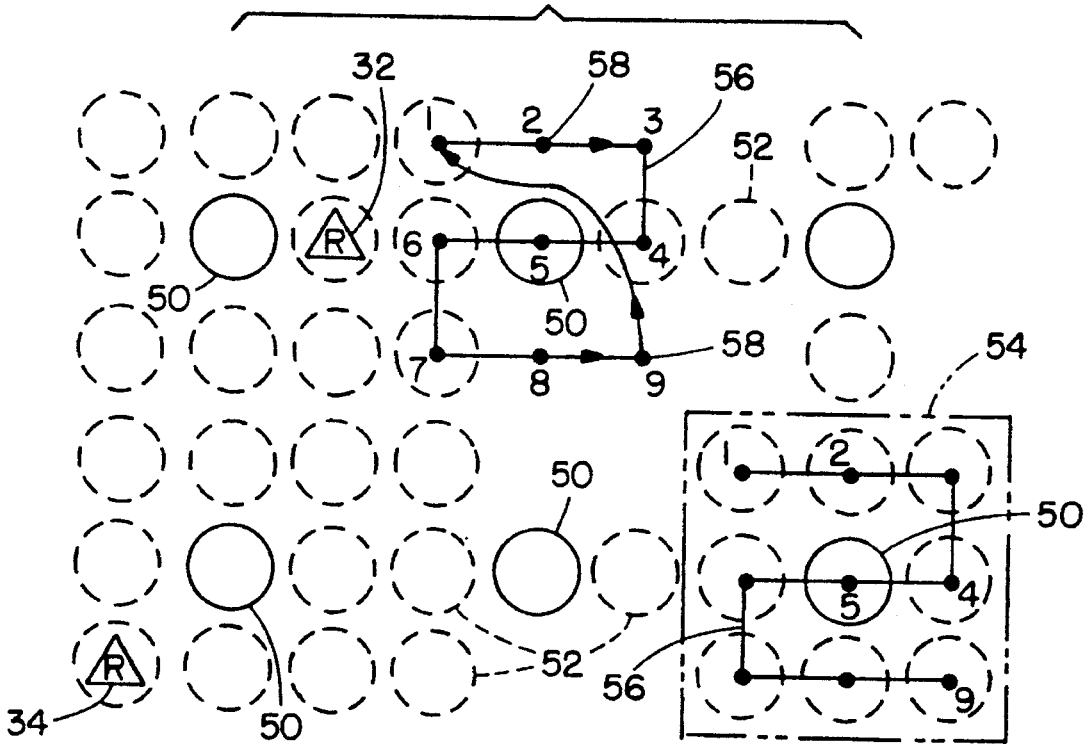
FIG. 3 is a diagram showing central locations of beams, as solid circles, on a surface illuminated by the antenna of FIG. 2, and an array of dithered beam positions, represented as dashed circles, encircling the central location of each beam.

FIG. 3 shows the gain contours 50 of FIG. 2. Each of the gain contours 50 of a respective one of the beams 48 (shown in FIG. 2) is surrounded in FIG. 3 by the gain contours 52 of dithered offset positions of the respective beams 48. Also shown in FIG. 3 are the two receiving stations 32 and 34 previously shown in FIG. 1. To simplify FIG. 3, some of the contours 52 have been deleted. A square-shaped frame 54 is provided to indicate a group of eight displaced contours 52 surrounding a central contour 50. Also shown in FIG. 3 is a possible path 56 by which a beam 48 progresses through a sequence of sequential stages 58 to carry the beam 48 cyclically through the central location of the beam, identified by the central contour 50 and through each of the displaced locations of the beam, identified by the contours 52.

In accordance with the invention, the radiation pattern of the antenna 42 provides for a divergence of axes of the respective beams 48 from the antenna 42 resulting in a multiplicity of the beams 48 spaced apart from each other at the earth's surface. The region in each beam of maximum gain and intensity of illumination of the earth's surface, at the central location of each beam is indicated by the circular gain contour 50. Outside the contour 50, the gain of the beam and the intensity of illumination is reduced. In order to compensate for the reduced intensity of illumination, the invention provides for a dithering of the position of the beam about the central beam location, as represented by the central contour 50. The dithering of the beam position along the earth's surface is indicated in FIG. 3 by the path 56 as the beam progresses through the successive stages 58, each of which represents a position of an axis of the beam 48, as the beam encircles and passes through the central location of the beam.

Figure 4:
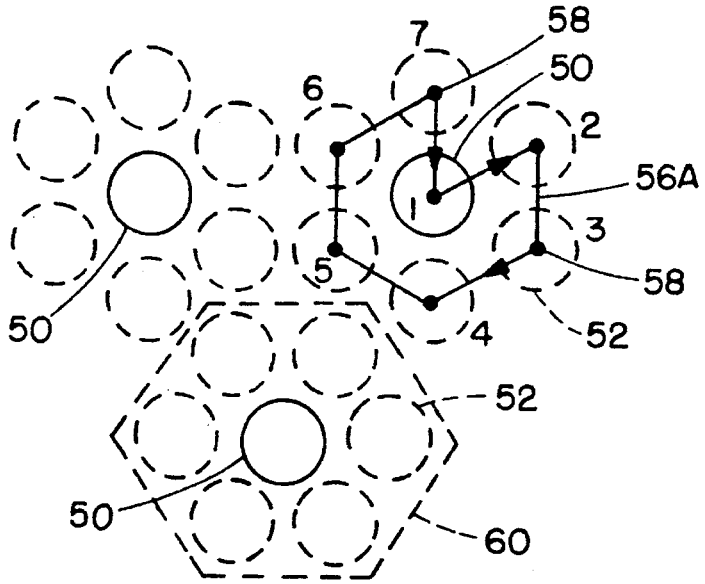
FIG. 4 shows, diagrammatically, an alternative arrangement of dithered beam positions about central locations of the beams.

The paths of dithered beam positions of the respective beams pass through the areas of reduced illumination between the central location in the respective beams so as to provide full intensity illumination to these areas, as well as to the central locations of the respective beams. Thus, the paths 56 pass through the displaced positions, represented by the contours 52, as well as through the central location, as represented by the contour 50. By way of example in a preferred embodiment of the invention, the path 56 of dithered beam positions for each of the respective beams traces an array of nine cells arranged within a square. The central cell is represented by the central contour 50 and the remaining cells are represented by the contours 52. Alternatively, by way of further example, the path may be reconfigured as path 56A shown in FIG. 4 to provide for a hexagonal array of six cells surrounding a central beam location. In FIG. 4, as in FIG. 3, the central location of the beam is represented by the solid contour 50, and the offset positions of the beam are represented by the dashed contours 52. In FIG. 4, a frame 60 encircles a hexagonal array of six displaced contours 52 which encircle a central contour 50. In each of the examples of the dithering of beam position, shown in FIGS. 3 and 4, the region enclosed by each array of beam positions provides with the contiguous regions of arrays of beam positions a continuum of substantially uniformly illuminated regions along the earth's surface.

For the case of TDMA transmissions, the respective cells of each array of beam positions on the earth's surface, as indicated by the beam positions within the frames 54 or 60, may receive a separate burst of time-division multiplex signals. Thus, in the case of the nine cells within the frame 54 of FIG. 3, there may be nine separate time-division channels with the respective channels designated for respective ones of the cells. The carrier frequency for the down-link transmissions differ to provide a separate frequency for each beam, the carrier frequency being the same for all of the dithered positions of any one beam. Thereby, receivers located on the earth's surface, such as receivers at the receiving stations 32 and 34, can be tuned to a specific down-link frequency based on a receiver's location, and to a specific one of a succession of sequential TDMA bursts based on a receiver's position within an array of dithered beam positions.

With reference to FIG. 3, the path 56 provides an example of one possible sequence of a succession of beam positions. The first beam position indicated by the first stage 58 is located in the upper left corner of the square-shaped array of the nine beam positions. The beam then moves towards the right to advance through a second and a third stage 58 of the path 56 so as to complete one row of three offset beam positions. Numerical identifications of the stages are shown in the figure. Then the beam advances to the next row at the fourth stage 58 and progresses to the left through the central location at the fifth stage and into an offset location at the sixth stage so as to complete a second row of beam positions. Thereupon, the beam advances to the seventh stage which is located in the third row, and advances to the right through the eighth and the ninth stages 58 to complete the bottom row of the offset beam positions. At the completion of a burst transmission at the ninth stage 58, the beam moves back to the first stage of the path 56 to begin a further cycle through the positions of the path 56. In similar fashion, with respect to FIG. 4, the beam progresses through the seven stages 58 of the path 56A.

Figure 5:
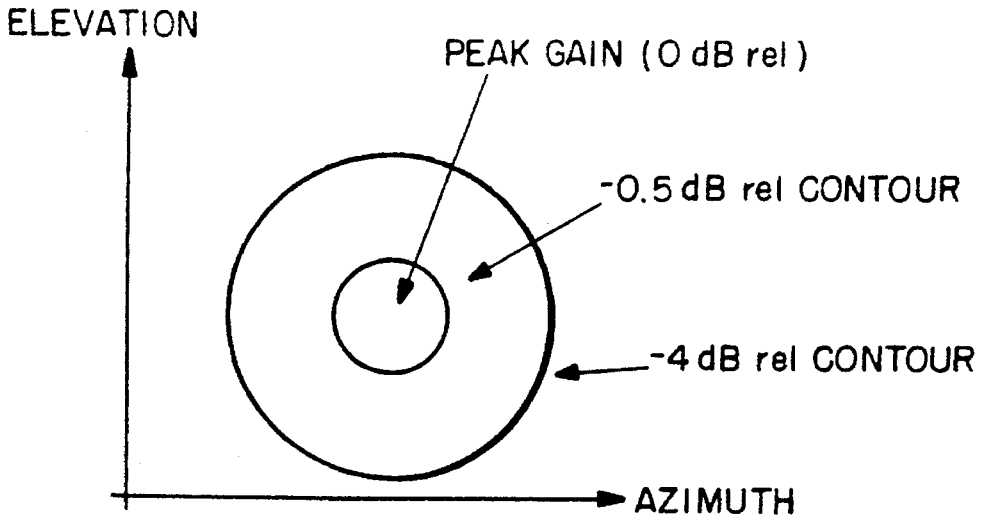
FIG. 5 is a graph showing varying intensity of electromagnetic power of a single beam upon a surface illuminated by the beam.

With reference to FIG. 5, the intersection of the beam 48 (shown in FIG. 2) may be represented by any one of a number of gain contours, two such contours being shown in FIG. 5. By way of example, FIG. 5 shows an inner gain contour of −0.5 dB relative to a central point having a maximum value of gain, and a further outer contour at the −4 dB level of power. For convenience in showing the spaced-apart positions of the beams in FIGS. 2, 3, and 4, the contour 50 in FIGS. 2, 3, and 4 has a value somewhat less than the −0.5 dB contour of FIG. 5, for example, a value of approximately −0.2 dB. The −4 dB contour is convenient for showing overlapping of areas of coverage, as will be presented in FIG. 6, and the −0.5 dB contour is convenient for showing variations in the intensity of the illumination as will be presented in FIG. 7.

Figure 6:
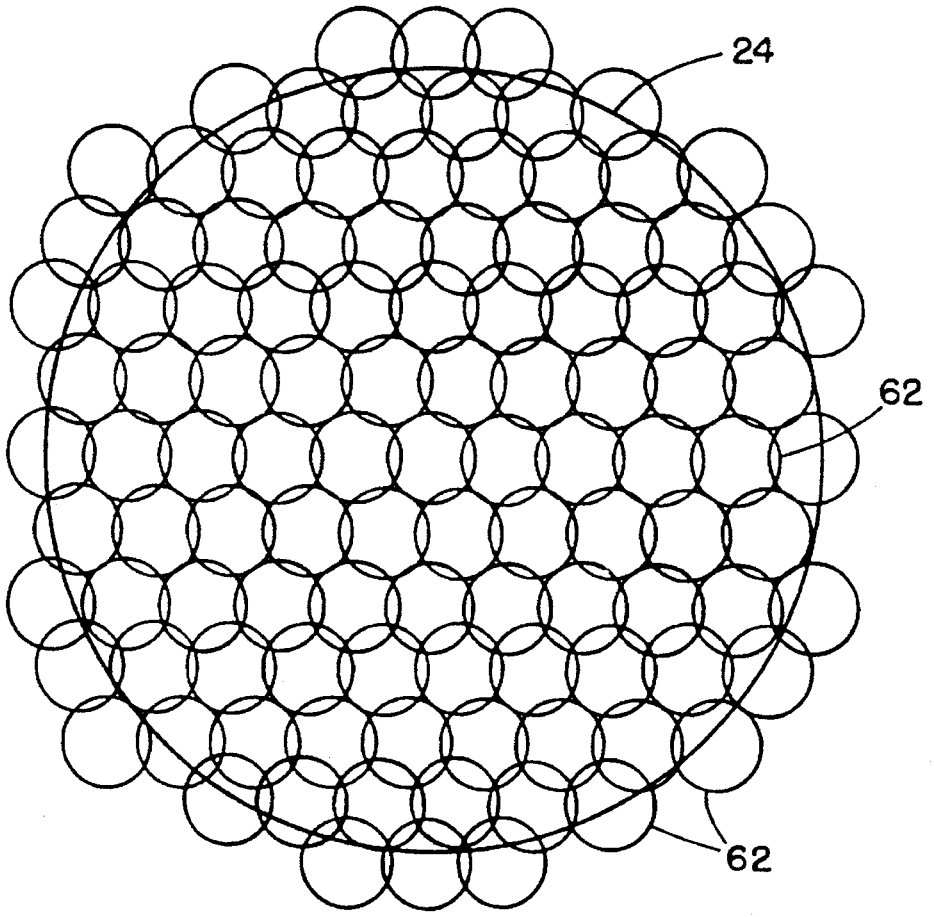
FIG. 6 shows schematically the illumination coverage of a hemisphere of the earth by means of 109 beams each having a divergence angle of 1.9° as measured to a gain contour wherein the gain is 4 dB below a peak gain, each beam being represented by a circle at the –4 dB gain contour.
Figure 7:
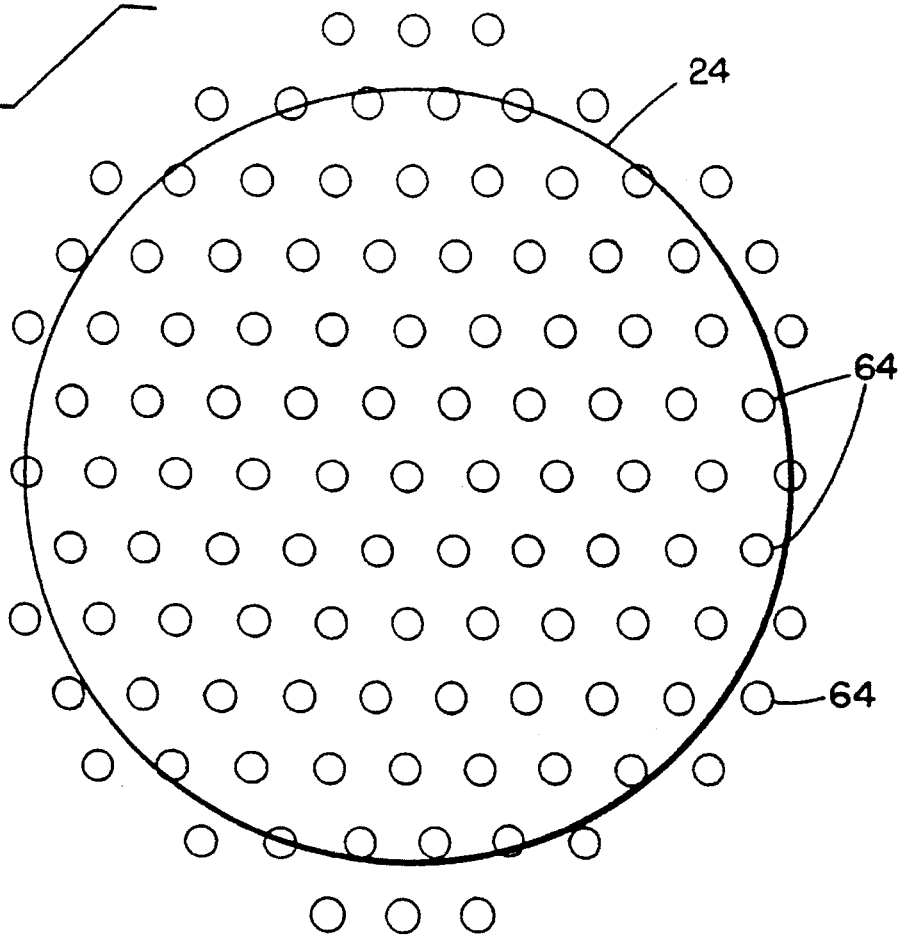
FIG. 7 shows the same arrangement of beams illuminating the earth's surface as does FIG. 6, wherein in FIG. 7 each of the beams is represented by a circle at the –0.5 dB gain contour.

FIG. 6 shows schematically the coverage of the earth with 109 beams, each of which has a 1.9° beam width as measured by the −4 dB gain contour. FIG. 6 demonstrates how the use of multiple beams can be implemented to cover a required area of the earth's surface with a matrix of high gain spot beams. This principle of coverage of a surface can be used for surfaces, other than the earth surface, which are to be illuminated with radiant energy. For the continuous coverage of a given region, the beams are located so that the coverage pattern of one beam intersects the coverage pattern of adjacent beams, and wherein the gain of each beam is reduced in the crossover region between the adjacent beams. For example, in the absence of the invention, the gain may be reduced in the intersection or crossover region by as much as several decibels below a beam peak intensity at the central axis of the beam. In the practice of the invention, as demonstrated in FIG. 3 and FIG. 4, the passage of the beam along a path outside a central location of the beam provides for high intensity illumination in the crossover regions so as to provide for a substantially uniform intensity of illumination across the entire region illuminated by the antenna. FIG. 7 shows schematically the same coverage of the earth's surface and with the same set of beams as is employed in FIG. 6, but with the beams being represented in FIG. 7 by the −0.5 dB gain contours. FIG. 7 clearly demonstrates the lack of uniformity of illumination intensity provided by diverging spaced-apart multiple beams, which lack of uniformity is compensated by use of the invention as has been described above.

Figure 8:
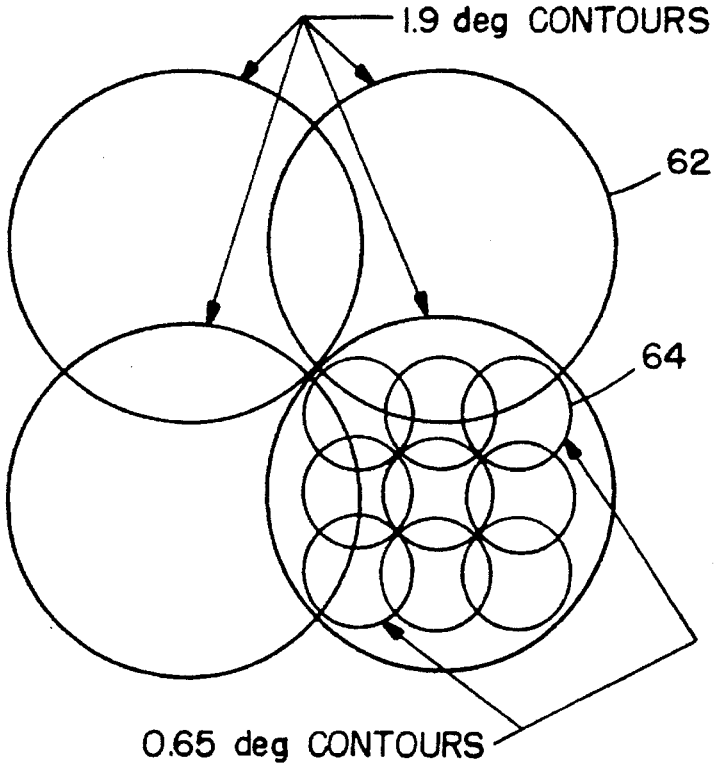
FIG. 8 is a diagram showing a portion of the area of coverage of FIG. 6 wherein each beam is represented by a circular contour of –4 dB gain, and wherein there is superposed in one of the beams a set of nine time-sequenced beams covering the area of the one beam, the nine time-sequenced beams being represented by circles at the –0.5 dB gain contour.

FIG. 8 provides a schematic representation of beam coverage similar to that shown in FIG. 3. However, the gain contours employed in FIG. 8 for describing each of the beams are larger than the gain contours employed in FIG. 3 so as to demonstrate the aspect of overlapping beam coverage to show uniformity of illumination. Each of the multiple beams is shown as having a beam width of 1.9° as measured to the −4 dB gain contour, shown at 62. This is the same contour as is employed in FIG. 6. Also shown in FIG. 8 is a set of nine contours 64 representing the succession of the nine positions of the beam, as disclosed previously within the frame 54 of FIG. 3, this being the same contour as employed in FIG. 7. However, in FIG. 8, the contour 64 represents the beam width of 0.65° as measured to the −0.5 dB power level. In FIG. 7, the widely spaced beam contours 64 show a lack of uniformity of illumination. In FIG. 8, the succession of beam offset positions provide for a relatively close spacing of the contours 64 resulting in a substantially uniform illumination. This is apparent in FIG. 8 because of the overlapping of the contours 64, each of which represent a relatively small departure from the peak beam amplitude since the contours 64 represent a −0.5 dB power level.

Figure 9:
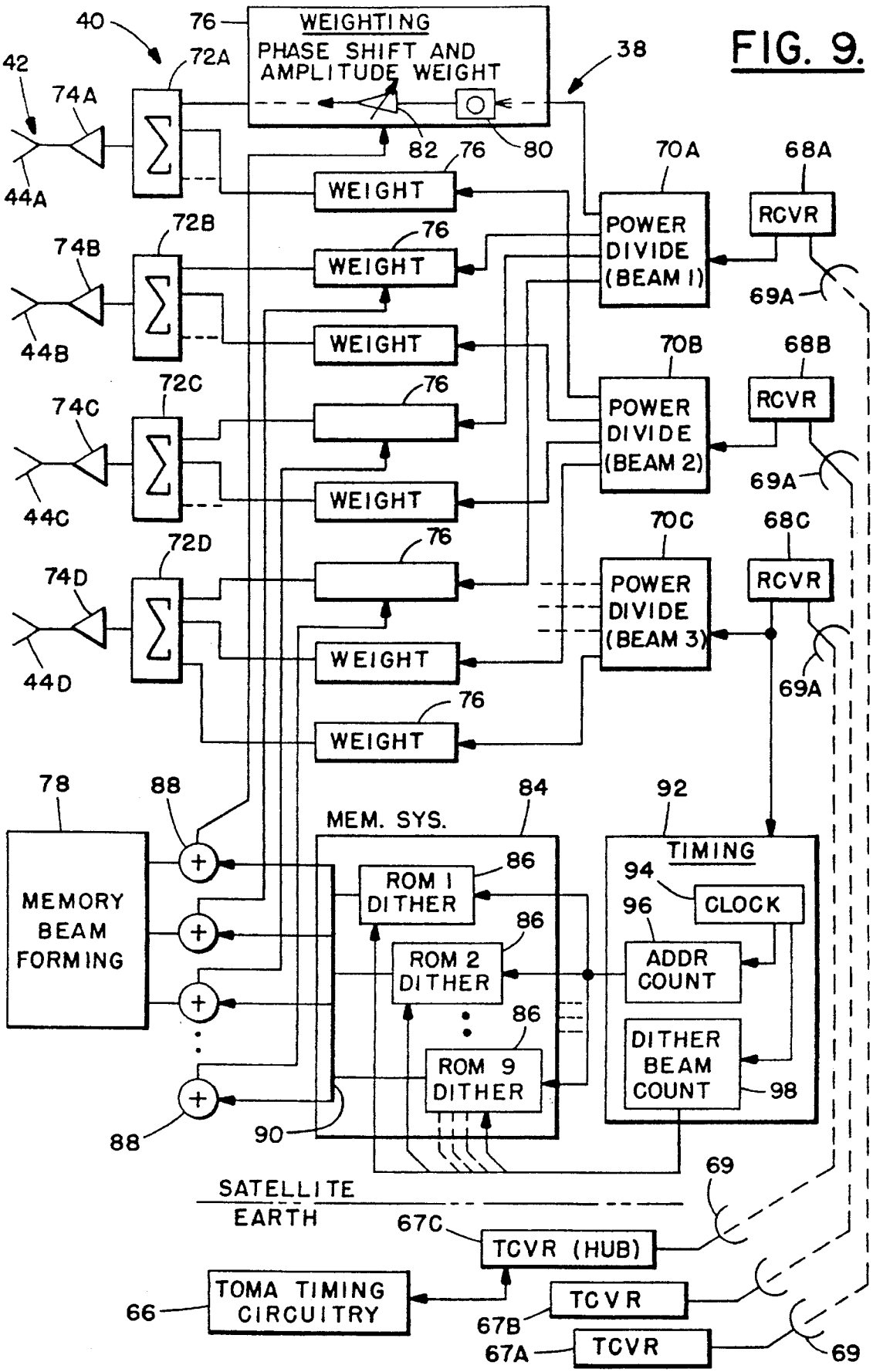
FIG. 9 is a diagram of a beam forming system connected to radiators of the antenna of FIG. 2 for forming the multiple beams and for generating the sequence of offset beam positions.

FIG. 9 shows a portion of the antenna system 40 carried by the satellite 22, and includes the array antenna 42 and the equipment 38 of FIG. 2. By way of example, four of the radiators 44 of the antenna 42 of FIG. 2 are shown also in FIG. 9, the radiators being identified in FIG. 9 as radiators 44A–44D. By way of example in the use of the invention, time-division multiple access (TDMA) timing circuitry 66 and multiple transceiver terminals, illustrated as a set of three transceiver terminals 67A–C, are located on the earth. The transceiver terminal 67C serves as a communications hub. Multiple receivers, illustrated as set of three receivers 68A–C, are located in the electronic equipment 38 of the satellite and serve as sources of signals to be transmitted by the antenna system 40. Communication between the transceiver terminals 67A–C and the corresponding receivers 68A–C is accomplished by a communication link indicated schematically by antennas 69 in individual ones of the transceiver terminals 67A–C, and antennas 69A connected to individual ones of the receivers 68A–C. The three antennas 69A are shown by way of example, it being understood that the receivers 68A–C may share a common antenna (not shown in FIG. 9), if desired. The TDMA timing circuitry 66 is located at the hub transceiver terminal 67C, and establishes and maintains the frame rate and slot times for the system 20 (FIG. 1). The multiple transceiver terminals 67A–C transmit burst signals to the multiple receivers 68A–C on the satellite.

The electronic equipment 38 on board the satellite further comprises power dividers 70A–C which receive the signals outputted by respective ones of the receivers 68A–C, and serve to divide the power of each of the receivers 68A–C among the four illustrated radiators 44A–D. Four summers 72A–D are coupled respectively by four amplifiers 74A–D to the radiators 44A–D for applying power from the dividers 70A–C to the radiators 44A–D to form three radiation beams from the antenna 42. The beams are identified as beam 1, beam 2, and beam 3. The power dividers 70A–C have output ports coupled via weighting units 76 to input ports of the summers 72A–D.

In the foregoing example of three beams produced by four radiators, there would be a total of twelve of the weighting units 76, only a portion of which are shown in FIG. 9 to simplify the drawing. To provide for the first beam, the power divider 70A has four output ports each applying one-quarter of the power of the receiver 68A via a set of four of the weighting units to a first input port of each of the summers 72A–D. In similar fashion, the power divider 70B couples one-quarter of the power of the receiver 68B via weighting units 76 to a second input port of respective ones of he summers 72A–D. In similar fashion, a third set of four of the weighting units 76 is employed in the coupling of power from four output ports of the divider 70C respectively to the third input port of the summers 70A–D. The summers 72A–D provide for a linear superposition of the signals of the separate beams upon the radiators 44A–D.

Figure 10:
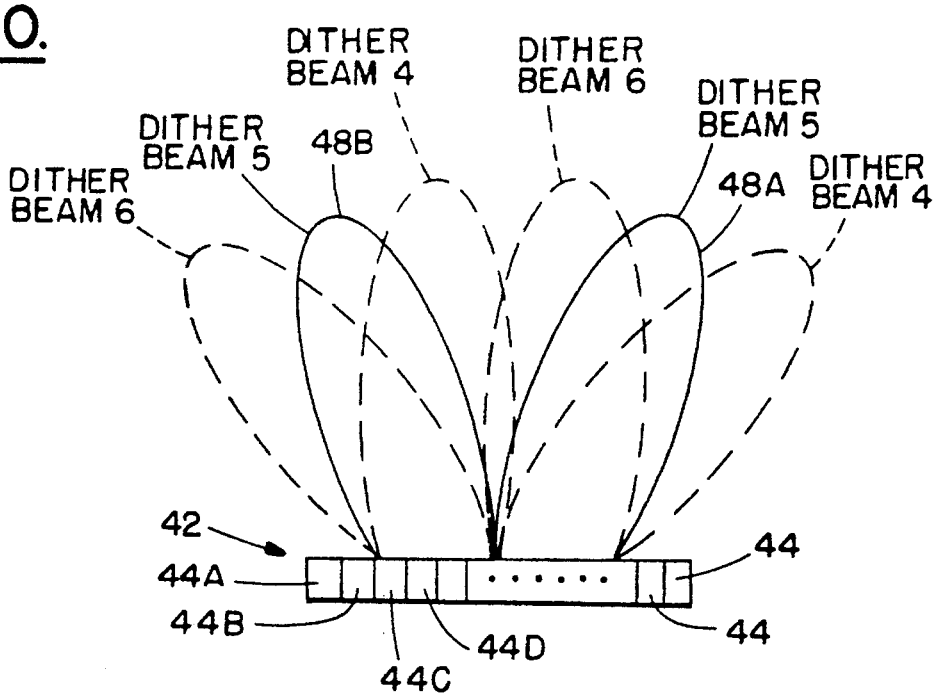
FIG. 10 is a stylized view of a plurality of beams produced by the antenna of FIG. 2, the view of FIG. 10 including offset or dithered positions of the beams.
Figure 11:
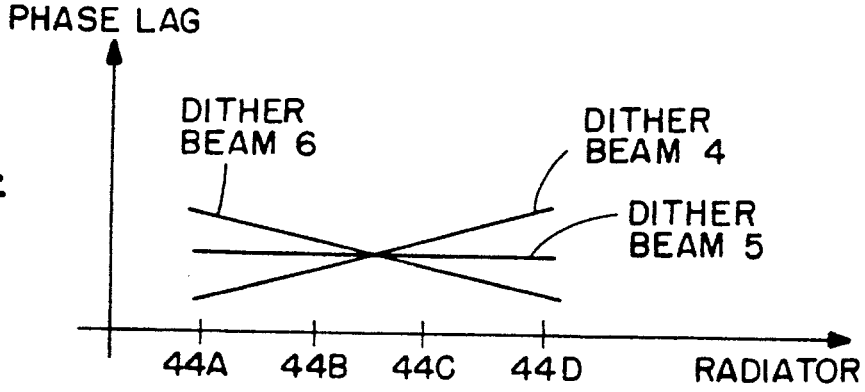
FIG. 11 is a diagram of phase shift applied to a set of four of the radiators of FIG. 2, the four radiators being identified also in FIG. 9, to attain the offset beam positions.

With reference to FIGS. 9–11, a beam-forming memory 78 stores amounts of phase shift and amplitude taper to be provided by the weighting units 76 to signals at each of the input ports of the summers 72A–D for generating the separate beams 48 of FIG. 2, two of the beams 48A and 48B being shown in FIG. 10. Each of the weighting units 76 includes a phase shifter 80 operative in response to a command signal received from the memory 78, and a gain control element 82 responsive to a command signal from the memory 78 for adjusting the gain of a signal applied to one of the radiators 24A–D relative to the gain of a signal applied to another of the radiators 44A–D.

In accordance with the invention, a memory system 84 is provided for adjusting the amounts of phase shift applied by the weighting units 76 to the signals inputted to the summers 72A–D, as shown in FIG. 11. This provides for an offsetting, or dithering, of the positions of the beams 48A and 48B (FIG. 10), in accordance with the dithering scheme set forth by the paths 56 of FIG. 3. To demonstrate the invention, FIG. 10 shows three beam positions, namely, the fourth stage, the fifth stage, and the sixth stage 58 of the path 56 in FIG. 3. As shown in FIG. 10, wherein the antenna 42 is simplified to show simply a line array of the radiators 44, and wherein the radiator 44A is located at the left end of the antenna 42, a tilting of the beam 48A from its central position, indicated in dashed line, is accomplished by introducing increasing amounts of phase lag to signals of the radiators 44A–D, as shown in FIG. 11. The same increasing amounts of phase lag are employed also for the shifting of the beam 48B from its central position, indicated in solid line, to the offset fourth dither beam position, indicated in dashed line, as is employed in the case of the beam 48A. In corresponding fashion, a shifting of the beam 48A as well as a shifting of the beam 48B to the sixth dither beam position is accomplished by introducing decreasing amounts of phase lag to the signals of the radiators 48A–D as shown in FIG. 11. To place each of the beams 48A and 48B in their central locations, this being the fifth dither beam position, the phase lag provided by the memory system 84 is the same for the signals of all of the radiators 44A–D.

The phase lag introduced by the memory system 84 to each of the respective signals at the input ports of the summers 72A–D, as depicted in FIG. 11, are provided in addition to the phase shift commanded by the memory 38. This is accomplished, as is shown in FIG. 9, by providing the memory system 84 with a set of nine read-only memories (ROM) 86 corresponding to the nine stages 58 of each path 56 in FIG. 3. Respective ones of the nine memories 86 store the amounts of phase lag required to produce the offsetting of the beam to the respective nine dithered beam positions. A set of adders 88 interconnect output terminals of the beam-forming memory 78 with the dither memories 86 to perform an addition of the dither phase command with the beam-forming phase command. The memories 86 may be provided with plural output ports connected with respective ones of the adders 88 or, alternatively, may output data via a data bus 90 to the respective adders 88.

The equipment 38 of the antenna system 40 further comprises a timing unit 92 having a clock 94 and two counters 96 and 98. The counter 96 is driven by clock pulses of the clock 94 to operate as an address counter for addressing the memories 86 to output the respective stored phase commands for the signals of the respective radiators 44A–D. The counter 98 is driven by clock pulses of the clock 94 to count from one to nine repetitively for selecting the memories 86 sequentially in accordance with the respective nine stages 58 of the paths 56 of FIG. 3. Thereby, by action of the counter 98, only one of the memories 86 is activated at a time to output the phase command to produce the specific dither position of one of the stages 58 on each of the paths 56.

In order to synchronize the dithering of the beams 48 of FIG. 2 with the time-division multiplexed signals of the respective beams provided by the receivers 68A–C, TDMA timing signals, outputted by the timing circuitry 66 and received by the receiver 68C, are applied by the receiver 68C to the timing unit 92. Thereby, by way of example, a burst transmission at a specific frequency transmitted via the first beam from the receiver 68A to the receiving station 34 (shown in FIG. 3) is accomplished when the transmitted beam is in the seventh dither position. By way of further example, with respect to a reception of a time-division signal burst via the second beam from the receiver 68B at the receiving station 32 (also shown in FIG. 3), this time-division signal burst is to be accomplished when the second beam is in the fourth dither position.

Thereby, the invention allows all of the receivers 68A–C to transmit signals at their respective frequencies for generating beams which are outputted by the radiators 44A–D to be applied to the receiving stations 32 and 34, as well as other numerous receiving stations not shown in the figures, by a set of beams which are dithered in position so as to ensure uniform illumination of the portion of the earth in which the receiving stations are located.

Figure 12:
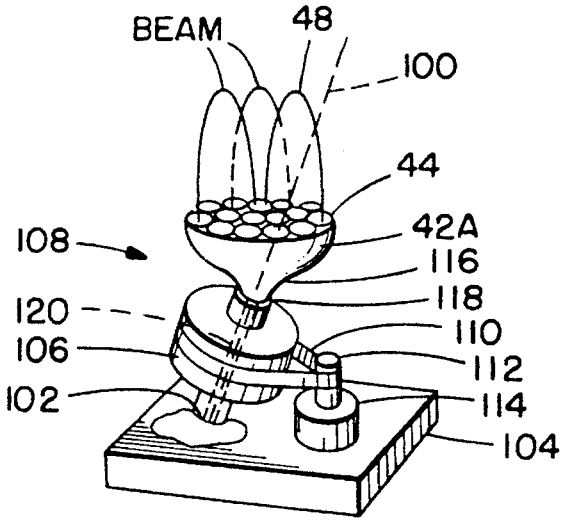
FIG. 12 is a stylized perspective view of apparatus for introducing an offsetting of the set of beams by introducing a mechanical movement antenna.

With respect to FIG. 12, and by way of further embodiment in the practice of the invention, the radiators 44 are provided with an alternative configuration of array antenna 42A to generate the beams 48. The boresight of the antenna 42A is cantered relative to a rotational axis 100. The antenna 42A is supported by a hollow shaft 102 mounted in a base 104. A pulley 106 fixed to the shaft 102 is rotated by a belt drive 108 having a belt 110 driven by a pinion 12. The pinion 112 is rotated by an electric motor 114 which is supported also by the base 104. A bottom 116 of the antenna 42A connects via a rotary coupling 118 to the top of the hollow shaft 102. A non-rotating rod 120 passes within the shaft 102, and connects from the antenna bottom 116 to the base 104 to restrain the antenna 42A from rotation, so as to provide for nutation of the antenna 42A upon rotation of the shaft 102. In operation, rotation of the shaft 102 nutates the antenna 42A about the axis 100, the cantering of the antenna 42A relative to the axis 100 producing a displacement of each beam 48 along a path similar to the path 56A of FIG. 4. The path of a beam 48 in FIG. 12 is circular while, in FIG. 4, the path is generally hexagonal with an excursion to the center. Thereby, the antenna of FIG. 12 also functions to enhance uniformity of illumination.

It is to be understood that the above described embodiments of the invention are illustrative only, and that modifications thereof may occur to those skilled in the art. Accordingly, this invention is not to be regarded as limited to the embodiments disclosed herein, but is to be limited only as defined by the appended claims.

What is claimed is:

1. An array antenna system comprising:

a plurality of radiators and a plurality of signal sources, each of said sources operating at a frequency different from the frequencies of the other sources;

a power divider system for dividing the signal power of each of said sources among a respective plurality of signal paths connecting with respective ones of said radiators;

weighting means disposed in the respective pluralities of signal paths for respective ones of said sources, said weighting means introducing relative phase shifts to signals among the plurality of paths from each source for forming a plurality of beams of radiation from said radiators, wherein axes of the beams are spaced apart from each other allowing the respective beams to illuminate separate areas of a receiving region, there being a space of reduced illumination between said separate illuminated areas;

offset means coupled to said weighting means for combining with said phase shifts a phase progression for offsetting a direction of a plurality of said beams to locate the beams within said reduced illumination space, wherein said offset means includes means for establishing a sequence of phase progressions for offsetting each of said plurality of beams in a sequence of offsets about a central position of said beam; and wherein said offsets are smaller than a spacing between said beams to provide for enhanced uniformity of illumination by said beams.

2. An antenna system according to FIG. 1 wherein said weighting means provides also for an amplitude weighting to signals among the plurality of paths from each sources for forming said plurality of beams of radiation from said radiators.

3. An antenna system according to FIG. 1 wherein the offsets of a plurality of said beams are accomplished concurrently and in parallel directions.

4. An antenna system according to FIG. 3 wherein the offsets of a plurality of said beams are equal.

5. An antenna system according to FIG. 1 wherein a maximum offset in said sequence of offsets is less than a width of one of said beams.

6. An antenna system according to FIG. 1 wherein a maximum offset in said sequence of offsets is less than half the width of one of said beams.

7. An antenna system according to FIG. 1 wherein the beams are spaced apart by approximately one beam width.

8. An antenna system according to FIG. 1 further comprising means for performing a time division multiplexing of data channels for the signals of respective ones of said sources, thereby to provide for a time division multiplexing of signals carried by said plurality of beams; and said offsetting is synchronized with said multiplexing to synchronize transmission of data via respective ones of said channels corresponding to said positions of each beam.

* * * * *